US005152507A

United States Patent [19]

Lee

[11] Patent Number: 5,152,507

[45] Date of Patent: Oct. 6, 1992

[54] GUARD RAIL ASSEMBLY FOR ROADS

[76] Inventor: Rahnfong Lee, 12th Fl., 207, Tun Hwa N. Rd., Taipei, Taiwan

[21] Appl. No.: 642,040

[22] Filed: Jan. 16, 1991

[51] Int. Cl.[5] ..... E01F 15/00

[52] U.S. Cl. ..... 256/13.1; 256/65; 256/66; 404/6

[58] Field of Search ..... 256/13.1, 64, 65, 66, 256/68, 69; 404/6, 7, 8

[56] References Cited

U.S. PATENT DOCUMENTS

| | | | |
|---|---|---|---|
| 3,617,076 | 11/1971 | Attwood et al. | 256/13.1 |
| 3,704,861 | 12/1972 | Glaesener | 256/13.1 |
| 4,358,090 | 11/1982 | Glaesener | 256/13.1 |
| 4,540,160 | 9/1985 | Zanavich et al. | 256/13.1 X |
| 4,739,971 | 4/1988 | Ruane | 256/13.1 |

FOREIGN PATENT DOCUMENTS

| | | | |
|---|---|---|---|
| 222161 | 7/1962 | Austria | 256/13.1 |
| 267576 | 1/1969 | Austria | 256/13.1 |
| 2028784 | 12/1971 | Fed. Rep. of Germany | 256/13.1 |
| 684871 | 3/1965 | Italy | 256/13.1 |
| 376535 | 5/1964 | Switzerland | 256/13.1 |

*Primary Examiner*—Peter M. Cuomo
*Assistant Examiner*—Heather Chun
*Attorney, Agent, or Firm*—Poms, Smith, Lande & Rose

[57] ABSTRACT

A guard rail assembly for roads comprising a first post, a second post, a fixing frame, a connector, and a pair of guard plates. The first post is a hollow squared structure filled with foamed plastics therein and is detachable and inserted into a second post buried in the ground. The connector is a corrugated plate having continuous vertical bending mounted on the first post. The pair of guard plates have a shape corresponding to the connector. Each end of the guard plate is engaged with the connector and fixed thereon.

3 Claims, 2 Drawing Sheets

GUARD RAIL ASSEMBLY FOR ROADS

BACKGROUND OF THE INVENTION

This invention generally relates to a guard rail assembly for roads, in particular, to using a set of detachable fiber reinforced plastic (FRP in abbreviation) posts in combination with FRP guard plates which is strong in structure and is very convenient to dismantle or install. The FRP structure formed from continuous glass fiber reinforced plastics has a strength greater than steel.

Conventional metallic guard rail assemblies are easily corroded after a certain period. Thus it is necessary to paint the guard rail frequently to keep it from corroding. In addition, the guard rail assemblies are heavy and they are time-consuming and laborious to change or install. When the guard rail is scraped by a car, the paint on the guard rail is easily scratched and when a car hits the guard rail, the impact causes a depression in the surface thereof changing its shape. When a car crashes into the guard rail, the car and the guard rail are damaged because of the high rigidity and poor damping effect of the guard rail; the driver and the passenger may be injured by such an accident. Furthermore, the posts used in conventional guard rail assemblies are made of concrete. A portion of the post is buried in the ground and the rest is upright above the ground. The concrete post must be changed if the guard rail assembly is struck by a car hard enough to cause the post to break. It is necessary to dig out the post and to bury a new post for replacement. It is troublesome to dig the post out of the ground. For installation of the post, a machine is always needed as auxiliary equipment. However, this way of installation may have adverse effects on traffic. Another kind of maintenance is to clear residual blocks of the post, then to straighten up the reinforcing bars which protrude above the ground and pour concrete around the bars to make a new post. This method takes more time to repair the guard rail assembly and is uneconomical. Furthermore, the level of road surface increases as the road surface undergoes repairing by covering with tar thereon. As a result, the conventional guard rail assembly becomes lower in comparison with the level of road surface. However, the height of the guard rail assembly in accordance with the present invention is easy to adjust with respect to the road surface.

SUMMARY OF THE INVENTION

It is therefore an object of this invention to provide a guard rail assembly for roads which mitigates the above drawbacks.

Another object of this invention is to provide a guard rail assembly for roads which is lightweight and can be replaced by hand in a short time.

A further object of this invention is to provide a guard rail assembly for roads which is safe in structure, wherein a FRP guard plate in accordance with the present invention can absorb a large amount of impact energy when the guard plate is struck by a car to protect the driver, the passenger, and even the car.

Yet another object of this invention is to provide a guard rail assembly for roads which can resist an impact force up to 4000 pounds without causing a guard plate to be damaged or to be permanently deformed.

It is still another object of the present invention to provide a guard rail assembly for roads which is low cost in maintenance It is still a further object of the present invention to provide a guard rail assembly for roads which is durable for its anti-rust and anti-corrosion ability, and has ozone, ultraviolet rays resistance.

These and other objects, advantages and features of the present invention will be more fully understood and appreciated by reference to the written specification and appended drawings.

DETAILED DESCRIPTION OF THE INVENTION

Reference will now be made in detail to the present preferred embodiment of the invention, an example of which is illustrated in the accompanying drawings.

Figure 1:
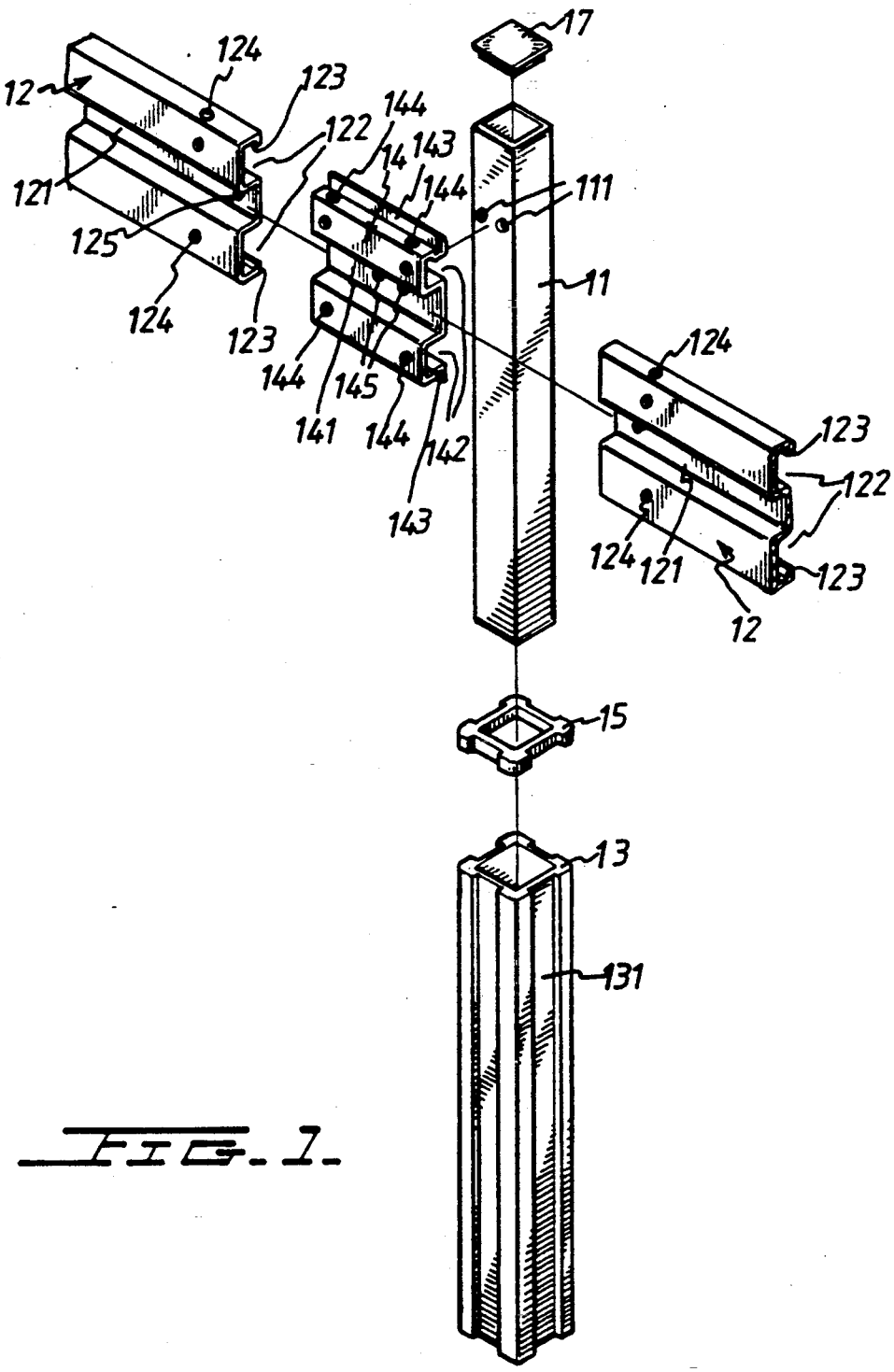
FIG. 1 is an exploded view illustrating the component parts of the present invention.
Figure 2:
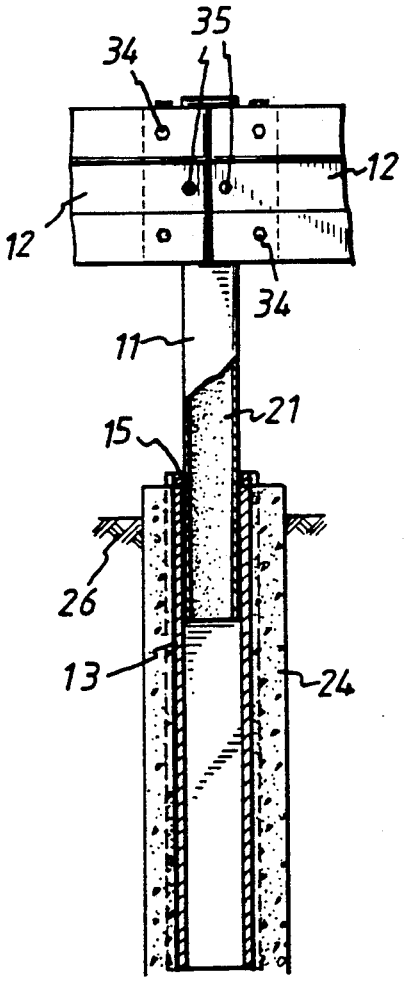
FIG. 2 is a front view partially in cross-section illustrating a pair of guard plates fixed on a first post and illustrating the first post inserted into a second post in accordance with the present invention.
Figure 3:
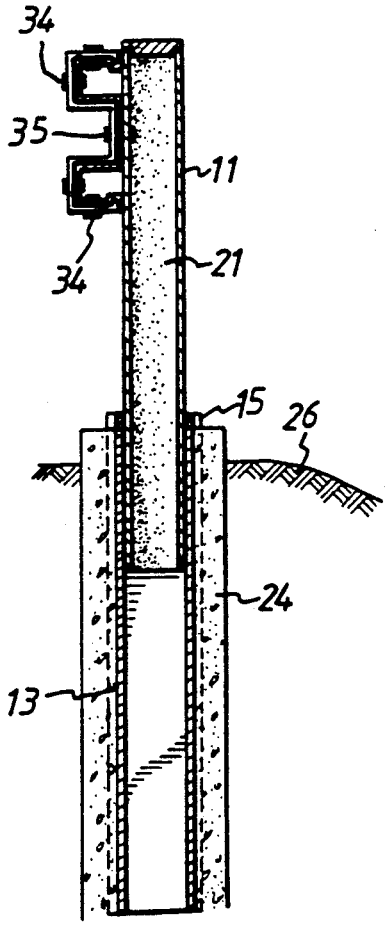
FIG. 3 is a cross-sectional view illustrating a guard plate engaging a connecting plate fixed on a first post in accordance with the present invention.

Referring now to FIG. 1, a guard rail assembly in accordance with the present invention comprises a first post (11), a second post (13), a fixing frame (15), a connector (14), and a pair of guard plates (12). The first post (11) is a hollow square structure wherein the hollow part is filled with foamed plastics (21)(as shown in FIG. 2 and 3). A cover (17) is inserted on the top of the first post (11). The connector (14) is a corrugated plate having continuous vertical bending. The cross-section of the connector (14) is substantially a square wave type. The configuration of the connector (14) is divided into three parts, wherein a groove (141) is formed along the center line of the connector (14) and an inverted groove (142) compared with the groove (141) is formed on each side of the groove (141). A pair of guiding slots (143) are provided on the upper edge and the lower edge of the connector (14), i.e., each guiding slot is formed along the edge of each groove (142). The groove (141) has a pair of holes (145) therein along its center line. The guard plate (12) is an elongated and corrugated plate having longitudinally continuous bending. The cross-section of the guard plate (12) is substantially a square wave type. The configuration of the guard plate (12) corresponds to the configuration of the connector (14), and equally a groove (121) is formed along the center line of the guard plate (12) and an inverted groove (122) compared with the groove (121) is formed on each side of the groove (121) except a pair of engaging edges (123) are provided on the upper edge and the lower edge of the guide plate (12) to engage with the connector (14) in the guiding slots (143) in a sliding manner. One side of the first post (11) is horizontally provided a pair of holes (111) for mounting the connector (14) by means of a pair of fixing elements (35) (as shown in FIG. 3) successively passing through a pair of holes (145) of the groove (141) provided at a location corresponding to the holes (111) of the first post (11) and passing the holes (111).

The pair of guard plates (12) slide along the guiding slots (143) of the connector (14) by the engaging edges (123) thereof from both ends of the connector (14) to touch each other at the middle of the connector (14). Each guard plate (12) is provided a hole (125) on the groove (121) at a location corresponding to the hole (145) of the connector (14) being passed by the same fixing element (35) as abovementioned to fasten the guard plate (12), the connector (14), and the first post (11). In addition, a plurality of holes (124) are provided on the inverted groove (122) near both ends (only one end is shown in FIG. 1) of the guard plate (12) and a plurality of holes (144) are provided on the inverted groove (142) near both ends of the connector (14) at a location corresponding to the holes (124) for keeping them secure by fixing elements (34) passing through the holes (124) and holes (144).

With reference to FIGS. 2 and 3, a second post (13) being a hollow squared structure having a channel (131) at each lateral surface thereof is buried in the ground. Concrete (24) is filled between the outer surfaces of the second post (13) and the ground (26) for fixing the second post (13) securely. A fixing frame (15) is mounted on the first post (11) near the bottom end of the first post (11) (preferably 30 cm above the bottom end) by screws (not shown) or adhesives. The bottom end of the first post (11) is inserted into the inner portion of the second post (13) until the fixing frame (15) comes into contact with the end of the second post (13) as a blockage. It should be noted that the perimeter of the outer wall of the first post (11) is approximately equal to the perimeter of the inner wall of the second post (13) for placing the first post (11) therein firmly.

Because the first post (11) is filled with foamed plastics (21) to produce powerful resistance against crumpling, it will not collapse as conventional concrete posts when the first post (11) is bumped by a car. Moreover, the strength of the first post (11) is over 7-8 times greater than that of conventional concrete post. In particular, the first post (11), the second post (13), the fixing frame (15), the connector (14), and the guard plate (12) can be made of fiber reinforced plastic (FRP) which is rigid in structure. Even if the guard rail assembly in accordance with the present invention is damaged by a car crash, it is easy to withdraw the first post (11) from the second post (13) and substitute a new set of the guard rail assembly.

Of course it is understood that the above is merely a preferred embodiment of the invention and that various changes and alterations can be made without departing from the spirit and broader aspects thereof as set forth in the appended claims.

I claim:

1. A guard rail assembly for roads comprising:

(a) a first post (11) having a hollow square structure filled with foamed plastics (21);

(b) a cover (17) inserted on one end of the first post (11);

(c) a corrugated plate connector (14) having continuous vertical bending and a configuration divided into three parts: a groove (141) formed along the center line of the connector (14) and an inverted groove (142) formed on each side of the groove (141), said connector (14) being mounted on one side of said first post (11);

(d) a pair of guard plates (12), each being an elongated and corrugated plate having longitudinally continuous bending and a configuration divided into three parts: a groove (121) formed along the center line of the guard plate (12) and an inverted groove (122) formed on each side of the groove (121), each end of said guard plates (12) being engaged to said connector (14) and fixed to said connector (14) at said groove and said inverted grooves (121 and 122) of each of said guard plates (12) so that said ends of the guard plates (12) touch at the middle of the connector (14);

(e) a fixing frame (15) being mounted on the first post (11) near the bottom end thereof; and (f) a second post (13) being a hollow squared structure having a channel (131) therein, said second post (13) being buried in the ground and the first post (11) being detachably inserted into said second post so that said fixing frame (15) comes into contact with a top of said second post (13).

2. A guard rail assembly for roads according to claim 1, wherein said connector (14) is provided with a pair of guiding slots (143) on the upper edge and the lower edge thereof; said guard plate (12) is provided with a pair of engaging edges (123) on the upper edge and the lower edge thereof; whereby said engaging edge (123) is slidably engaged with said sliding slot (143).

3. A guard rail assembly for roads according to claim 1, wherein said first post (11), said connector (14), said guard plates (12) and said second post are made out of fiber reinforced plastic.

* * * * *